United States Patent [19]

Meyer et al.

[11] Patent Number: 4,959,582

[45] Date of Patent: Sep. 25, 1990

[54] VIDEO STORAGE CABINET

[75] Inventors: James M. Meyer, Oshkosh; David A. Schmidt; Peter M. Donner, all of Oshkosh, Wis.

[73] Assignee: Imago Quaestus, Inc., Oshkosh, Wis.

[21] Appl. No.: 901,143

[22] Filed: Aug. 28, 1986

[51] Int. Cl.[5] ..... A47B 88/00

[52] U.S. Cl. ..... 312/307; 312/304; 16/358

[58] Field of Search ..... 312/305, 307, 322, 350, 312/304; 49/257, 260; 16/357, 358, 359, 360, 361, 362

[56] References Cited

U.S. PATENT DOCUMENTS

| | | | |
|---|---|---|---|
| 330,409 | 11/1885 | Larson | 312/322 |
| 535,886 | 3/1895 | Brand | 312/322 |
| 859,720 | 7/1907 | Appelhans | 312/307 |
| 1,055,109 | 3/1913 | Whitaker | 312/322 |
| 2,202,277 | 5/1940 | Visser | 312/322 |
| 2,650,871 | 9/1953 | Holdregger | 312/322 |
| 4,124,262 | 11/1978 | Schill | 312/307 |

FOREIGN PATENT DOCUMENTS

| | | | |
|---|---|---|---|
| 0412648 | 7/1934 | United Kingdom | 312/273 |

*Primary Examiner*—Kenneth J. Dorner
*Assistant Examiner*—Gerald A. Anderson
*Attorney, Agent, or Firm*—Foley & Lardner

[57] ABSTRACT

A Hinge Assembly for supporting a storge-type door in a cabinet, the assembly including a cabinet plate in the form of a square having guide grooves along two sides, the grooves intersecting at one corner of the square, a door plate mounted on the cabinet plate for rotary motion between a first position in alignment with one edge of the door plate in alignment with one edge of the first plate to a second position with one edge of the door plate in alignment with the other edge of the cabinet first plate, the door plate having two guide members on the one edge, the guide members being aligned in one of the grooves in the first position and moveable into the other of the grooves on rotation of the door plate with respect to the cabinet plate whereby the door plate rotates within the angle formed between the guide grooves, and a pivot post on one of the plates and a guide member on the other of the plate having a track to define the path of motion for the pivot post on rotation of the door plate with respect to the cabinet plate.

5 Claims, 3 Drawing Sheets

VIDEO STORAGE CABINET

BACKGROUND OF THE INVENTION

The popularity of video recording devices has created a need for storage of the tapes produced from these devices. Users have found that a large number of tapes can be accumulated in a very short period of time, which requires the tapes to be cataloged and stored in a convenient location. One requirement of such storage devices is that they be compact and at the same time readily accessible for use. In order to increase the storage space within a cabinet, storage shelves are often provided on the inside of the door. The weight of material stored on the doors is limited to the load capacity of the hinge assembly.

SUMMARY OF THE INVENTION

The present invention is concerned with the storage of videotape cassettes in small compact cabinets. The cabinet must also be capable of protecting the tapes from dust and other damage if not properly stored. The cabinet is designed to accommodate the storage of video cassettes both within the cabinet and on the inside of the door for the cabinet. The door is designed to be opened to provide access to the tapes, as well as protecting the tapes from damage. The increased weight of the door is carried by a unique hinge assembly which rotates within the cabinet so that a significant amount of the door weight is pivoted within the cabinet.

IN THE DRAWINGS

DESCRIPTION OF THE INVENTION

Figure 1:
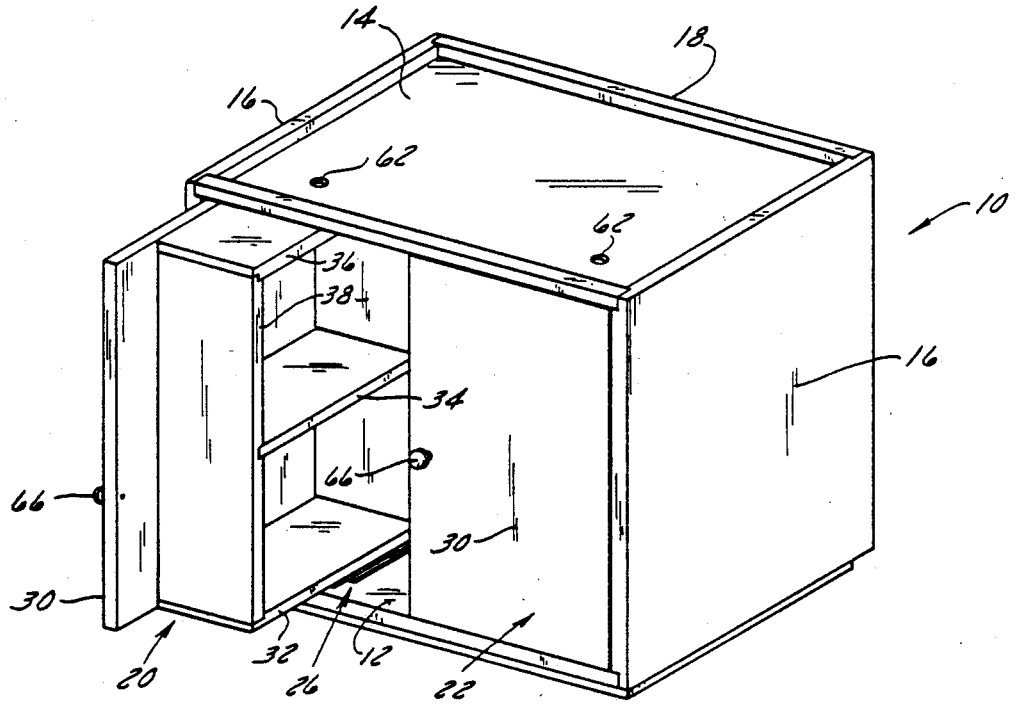
FIG. 1 is a perspective view of the storage cabinet according to the invention.
Figure 2:
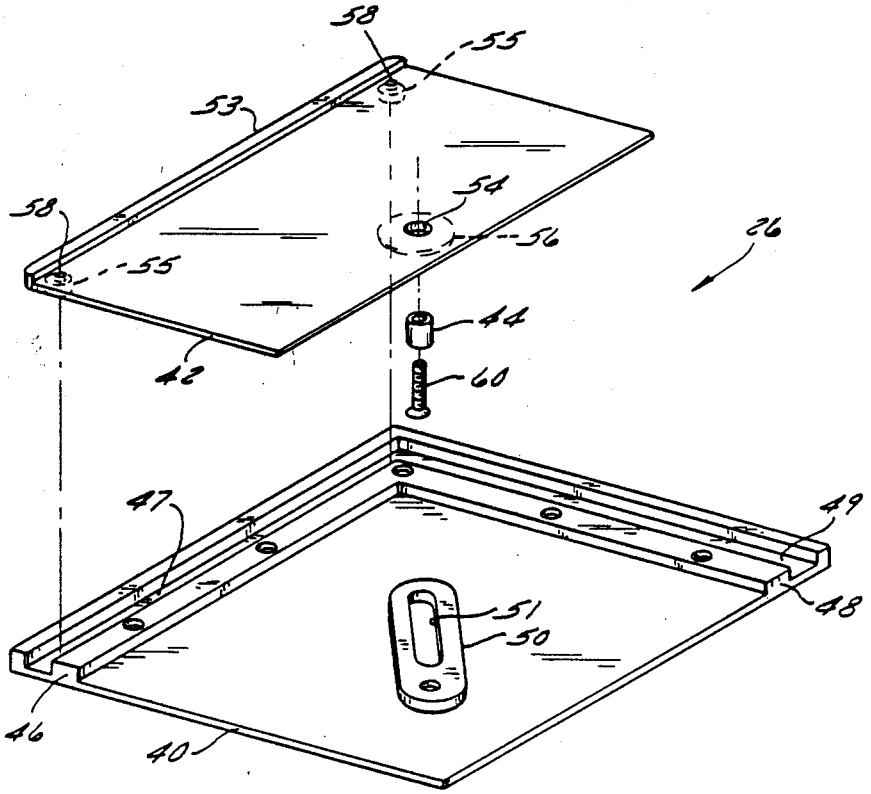
FIG. 2 is an exploded perspective view of the door hinge support assembly.
Figure 3:
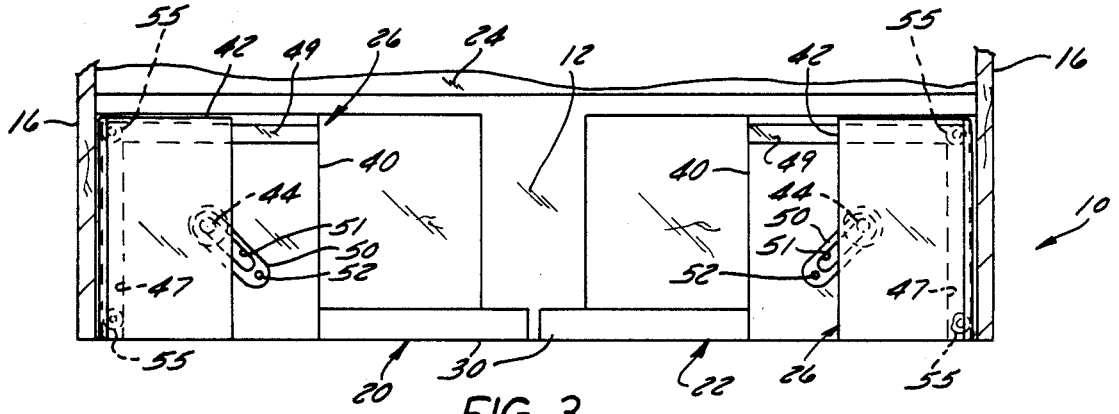
FIG. 3 is a section view showing the cabinet door hinge support assembly.

The storage cabinet 10 according to the present invention, includes a bottom panel 12 and a top panel 14, enclosed by side walls 16 and a back wall 18. Mounting holes 62 are provided in the bottom panel 12 and top panel 14. The front of the cabinet is closed by means of door assemblies 20 and 22. In this regard, each of the door assemblies includes a door 30 having a number of shelves 32, 34 and 36 mounted on the inside of the door 30 and enclosed by side walls 38. A shelf 24 can be provided on the back wall 18.

In accordance with the invention, the door assemblies 20 and 22 are supported in the cabinet 10 by means of hinge assemblies 26 which are designed to allow for pivoting of the door assembly within the cabinet so that the weight of the doors is carried by the hinge assemblies. It should be noted that the door assemblies 20 and 22 when filled with tapes are heavy and therefore, cannot be supported by a standard hinge located at the edge of the door.

Each of the hinge assemblies 26 includes a cabinet plate 40, a door plate 42 and a pivot post 44. The cabinet plate 40 includes a guide track 46 having a groove 47 on one side of the plate 40 and a guide track 48 having a groove 49 along the back edge of the plate 40. The grooves 47 and 49 intersect at a right angle to form a continuous path of travel. Means are provided on the cabinet plate to pivot the door plate with respect to the cabinet plate. Such means is in the form of a member 50 provided as an integral part of the cabinet plate 40. A pivot post track 51 is provided in the center of the member 50 which is aligned with a diagonal line drawn from the opposite corners of the cabinet plate at the intersection of the grooves of 47 and 49. The cabinet plate 40 is secured to the inside of the cabinet at the top and bottom of both of the front corners of the cabinet by means of screws 41 and 52.

The door plate 42 includes a flange 53 on one side and an opening 54 at the midpoint of the other side of the plate. A pair of circular guide members 55 are secured to the bottom of the corners of the plate 42 by screws 58. A spacer ring 56 is secured to the under side of the door plate in alignment with the opening 54. The door plate 42 is secured to the bottom of the cabinet door by the screws 58 which pass through the guide members 55. The pivot posts 44 are secured to the bottom shelf 32 and top shelf 36 by screws 60 which pass through the hole 54 in spacer ring 56.

The door is assembled in the cabinet by initially mounting the cabinet plates 40 on the bottom panel 12 and the top panel 14 of the cabinet by screws 41. The door plates 42 are then mounted on the ends of the top and bottom of the shelves and attached thereto by the screws 58 which pass through the guide members 55. The door assembly 20 or 22 is mounted in the cabinet by aligning the members 55 with the grooves 47 in the plate 40. The assembly is then pushed into the cabinet until the openings 54 are aligned with one of the openings 62 in the bottom panel 12 or top panel 14. The pivot post 44 is inserted through opening 62 into the opening 54 in the door plate 42. The wood screw 60 is inserted through hole to 2 into the hole in post 44 and screwed into the corresponding shelf in the door assembly. The post 44 will be aligned in the track 51 in the member 50. It should be noted that the weight of the door is carried between the door plates 42 and the spacer ring 56 which rides on the support plate 50.

Figure 4:
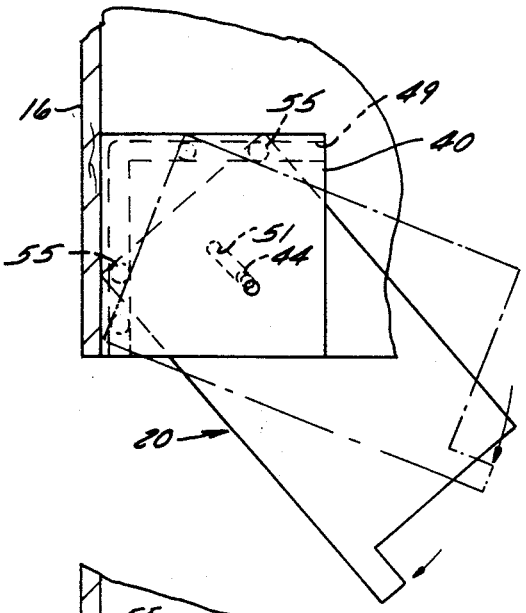
FIG. 4 is a schematic view of the operation of the hinge assembly.
Figure 5:
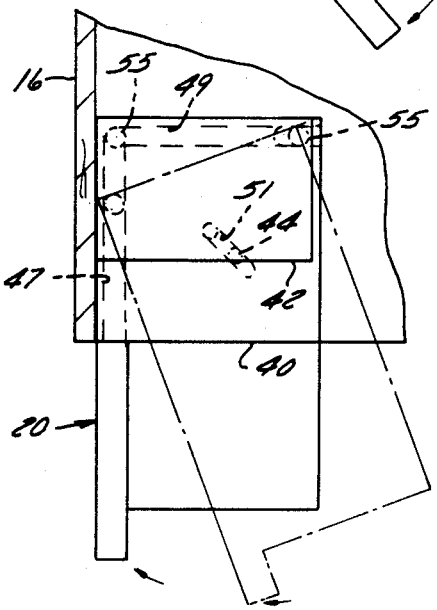
FIG. 5 is a schematic view of the operation of the hinge assembly.
Figure 8:
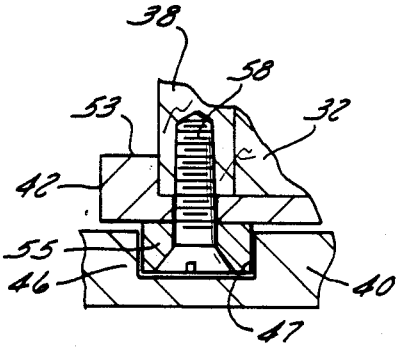
FIG. 8 is a section view of the guide pin for the hinge assembly.
Figure 7:
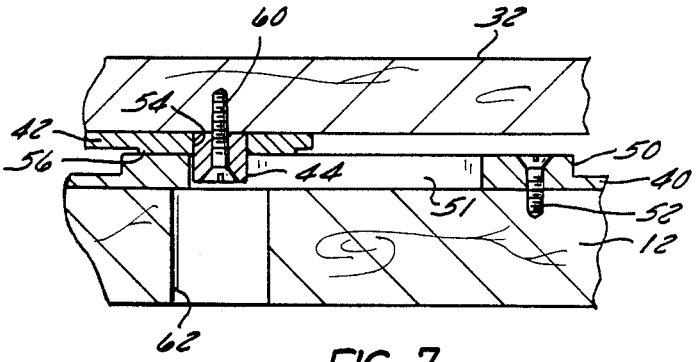
FIG. 7 is a section view of the support plate for the hinge assembly.
Figure 6:
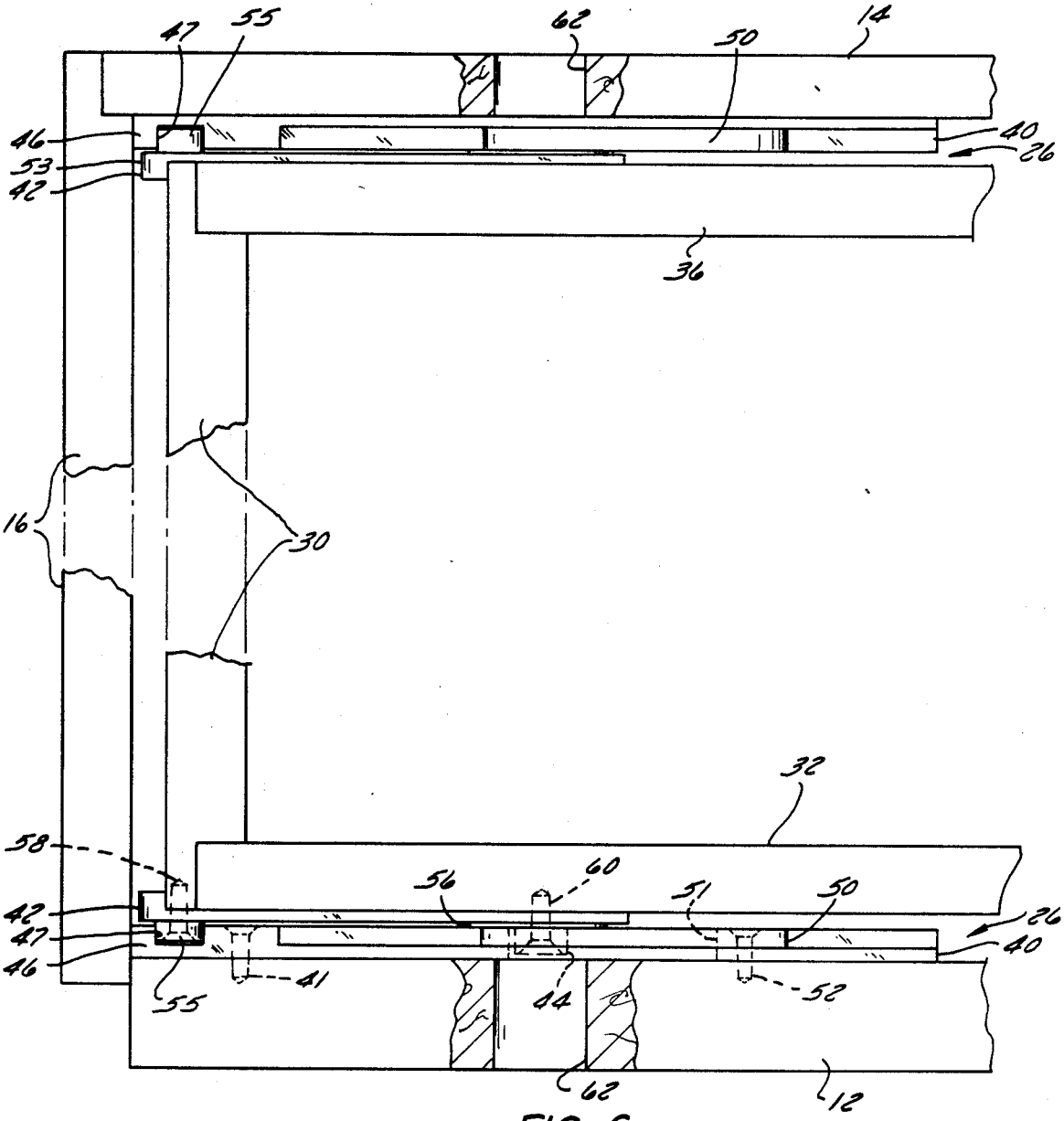
FIG. 6 is a section view partly broken away to show the hinge assembly.

The door assemblies 20 and 22 are opened by pulling on the door knobs 66 to pivot the assembly initially about post 44. The guide members 55 will move in straight lines in the grooves 46 and 48. As the door assembly pivots about the pivot post 44, the pivot post will move in a diagonal line in the lock post track 51 as seen in FIGS. 4 and 5 due to the motion of the members 55 as they slide in the grooves 46 and 48. When the door assembly is closed, the post 44 will be at the end of guide track 51 and the guide members 55 will be in groove 47. When the door assembly is in the full open position, the lock post 44 will again be located at the end of the guide track 51 and the guide members 55 will both be in alignment in the groove 49. In the movement of the door between the open and closed positions the pivot post 44 moves from one end of the track 51 to the other end and back.

The pivotal movement of the door within its hinge assemblies can be more accurately described as a rotation of a square within a square. The guide members 55 moving in straight lines in the grooves 47 and 49 during both the opening and closing movement, with the portion of the door carried between the hinge assemblies rotating within the cabinet.

We claim:

1. A hinge assembly for supporting a storage type door for movement between an open position and a closed position in a cabinet, said assembly comprising a first plate in the form of a square adapted to be mounted in a cabinet, said first plate having a groove along two sides of the square, said groove intersecting at a right angle, supporting means defining an elongate guide track on said first plate, said guide track being aligned with a diagonal line drawn through the intersection of said grooves and the opposite corner of the square in said first plate, and a second plate adapted to be mounted on the storage door and having two guide members mounted on one edge of said second plate, said second plate being mounted on said first plate with said guide members aligned in one of the guide grooves and a pivot post mounted on said second plate and aligned in said guide track, whereby the portion of the door supported by the second plate will pivot within said square defined by said first plate in the cabinet on movement of the door between the open position and the closed position.

2. A hinge assembly for a storage cabinet having storage type doors, said assembly comprising a cabinet plate in the form of a square mounted in the cabinet and having guide grooves along two sides of the square which intersect at a right angle, a support member on said cabinet plate in axial alignment with a diagonal line drawn through the intersection of the guide grooves and the opposite corner of the square, an elongate guide track in said support member aligned with said diagonal line and a door plate mounted on the door and having guide members mounted on two corners of one edge of said door plate, said door plate being mounted on said cabinet plate with said guide members aligned in one of said guide grooves, and a pivot post mounted on said door plate in alignment with said elongated track in said support member, whereby the portion of the storage doors supported by said door plate will rotate within the cabinet on movement of said guide members from said one groove to the other groove.

3. A hinge assembly comprising a first plate in the form of a square having grooves along two sides of the square and intersecting at one of the corners of the square, a second plate mounted on said first plate for rotary motion between a first position with one edge of said second plate in alignment with one edge of the first plate to a second position with said one edge of said second plate in alignment with the other edge of said first plate, said second plate having two guide members on said one edge, said guide members being aligned in one of said grooves in said first position and moveable into the other of said grooves on rotation of said second plate to the second position with respect to said first plate, a pivot post on one of said plates, and a support member on the other of said plates, said support member including an elongate track to define a path of motion for the pivot post along a diagonal line which intersects the intersection of the grooves and the opposite corner of the square whereby on rotation of the second plate with respect to the first plate said second plate rotates within the square formed by said first plate.

4. A hinge assembly for supporting a storage type door for movement between an open position and a closed position in a cabinet, said assembly comprising a first plate adapted to be mounted in a cabinet, said first plate having a groove along two sides, said grooves intersecting at a right angle, supporting means defining an elongate guide track on said first plate, said guide track being aligned with a line drawn through the intersection of said grooves in said first plate, and a second plate adapted to be mounted on the storage door and having a two guide members mounted on one edge of said second plate, said second plate being mounted on said first plate with said guide members aligned in one of the guide grooves and a pivot post mounted on said second plate and aligned in said guide track, whereby the portion of the door supported by the second plate will pivot within the cabinet on movement of the door between the open and the closed position, and means in said second plate for removing said pivot post from said guide track to allow for removal of the first plate from said second plate being mounted in the cabinet.

5. A hinge assembly comprising a first plate in the form of a square having grooves along two sides of the square and intersecting at one of the corners of the square, a second plate mounted on said first plate for rotary motion between a first position with one edge of said second plate in alignment with one edge of the first plate to a second position with said one edge of said second plate in alignment with the other edge of said first plate, said second plate having tow guide members on said one edge, said guide members being aligned and one of said grooves in said first position and moveable into the other of said grooves on rotation of said second plate to the second position with respect to said first plate, a pivot post on one of said plates, and a support member on the other of said plates, said support member including an elongate track to define a path of motion for the pivot post on rotation of the second plate with respect to the first plate whereby said second plate rotates within the square formed by said first plate, and including means in said one of said plates for removing said pivot post from the guide track on the other of said plate to allow for removal of the guide members from the grooves in said first plate.

* * * * *